US005121522A

United States Patent [19]

Leifeld et al.

[11] Patent Number: 5,121,522

[45] Date of Patent: Jun. 16, 1992

[54] HUMIDITY AND TEMPERATURE AIR CONDITIONING IN A TEXTILE PROCESSING LINE

[75] Inventors: Ferdinand Leifeld, Kempen; Stephan Schlichter, Mönchengladbach, both of Fed. Rep. of Germany

[73] Assignee: Trützschler GmbH & Co., KG, Mönchengladbach, Fed. Rep. of Germany

[21] Appl. No.: 631,463

[22] Filed: Dec. 21, 1990

[30] Foreign Application Priority Data

Dec. 22, 1989 [DE] Fed. Rep. of Germany ..... 3942441

[51] Int. Cl.[5] ..... D01G 23/08; D01G 37/00

[52] U.S. Cl. ..... 19/66 CC; 19/0.27; 19/66 R; 19/98; 19/150

[58] Field of Search ..... 19/0.27, 65 A, 65 R, 19/66 CC, 98, 99, 144, 150, 200

[56] References Cited

U.S. PATENT DOCUMENTS

| | | | |
|---|---|---|---|
| 3,005,238 | 10/1961 | Manning | 19/66 R |
| 3,277,581 | 10/1966 | Towery et al. | 19/0.27 |
| 3,280,474 | 10/1966 | Van Doorn et al. | 19/66 CC |
| 3,357,061 | 12/1967 | Jackson | 19/66 R |
| 3,357,062 | 12/1967 | O'Neal et al. | 19/107 |
| 3,363,286 | 1/1968 | Scott et al. | 19/66 CC |
| 3,391,428 | 7/1968 | Whitehurst | 19/66 R |
| 3,821,833 | 7/1974 | Wildbolz ett al. | 19/66 R |
| 3,881,222 | 5/1975 | Roberson | 19/66 R |
| 4,527,306 | 7/1985 | Thannheiser | 19/66 CC |
| 4,943,300 | 7/1990 | Vinnikov | 19/66 CC |

FOREIGN PATENT DOCUMENTS

| | | |
|---|---|---|
| 2324336 | 12/1974 | Fed. Rep. of Germany . |
| 3228672 | 2/1984 | Fed. Rep. of Germany . |

*Primary Examiner*—Werner H. Schroeder
*Assistant Examiner*—Ismael Izaguirre
*Attorney, Agent, or Firm*—Spencer, Frank & Schneider

[57] ABSTRACT

A fiber tuft processing line for processing fiber tufts preparatory to spinning, includes a plurality of fiber processing machines, fiber tuft conveying ducts serially connecting the machines, a blower generating a fiber tuft conveying air stream flowing in the fiber tuft conveying ducts, and an air conditioning system for supplying conditioned air to the machines of the fiber processing line. The air conditioning system includes an air conditioner; conditioned air conveying ducts extending from an output of the air conditioner to the machines; a humidity sensor and temperature sensor for responding to humidity and temperature conditions in the processing line; and a regulator for operatively connecting the humdiity sensor and the temperature sensor with the air conditioner. The humidity sensor is arranged to respond directly to the humidity of the fiber tufts in the processing line.

13 Claims, 3 Drawing Sheets

41
40
42
43
33h
34h
39
CLEANER
44
47
TUFT CHARGER
M1
M2
48
55
56
53
54
46
51
51'
52
52'
SETTING MEMBER
SETTING MEMBER
49
49'
TRANSDUCER
45
50
50'
TRANSDUCER
CONTROL DEVICE
58
27
REGULATOR
59
60
61
AIR CONDITIONING SYSTEM
37
57
63
62
AIR QUANTITY SETTER
TEMPERATURE SETTER
HUMIDITY SETTER

HUMIDITY AND TEMPERATURE AIR CONDITIONING IN A TEXTILE PROCESSING LINE

CROSS REFERENCE TO RELATED APPLICATION

This application claims the priority of Federal Republic of Germany Application No. P 39 42 441.3 filed December 22nd, 1989, which is incorporated herein by reference.

BACKGROUND OF THE INVENTION

1. Field of the Invention

This invention relates to an apparatus for air conditioning a textile fiber processing line formed of a plurality of machines such as a bale opener, a mixer, a cleaner, a fiber tuft feeder, a carding machine and the like which are connected to one another by means of pneumatic fiber conveying ducts. Such a fiber processing line is typical in the field of spinning preparation.

2 Description of the Related Art

The apparatus is connected with an air conditioner for supplying conditioned air and further, the apparatus includes measuring sensors which are connected to the air conditioner by means of a regulating device and which respond to humidity and temperature conditions.

In pneumatic fiber tuft conveying systems the fiber material is advanced by a transporting medium such as an air stream through a conduit and is admitted to one or more machines, such as a fiber bale opener, a cleaner or a conveying machine or cards equipped with feed chutes. The machines are interconnected by a common conveying duct. The fiber material which is advanced in the conduit as fiber tufts does not have a constant behavior. Thus, it is a frequent occurrence that, for example, in branches or bends of the conveying conduit or at the inner wall faces thereof fiber tuft accumulations occur. This not only hinders the conveyance of fiber in the conduit but, in particular, prevents a downstream-arranged machine from uniformly receiving or further processing the fiber tufts or from uniformly charging, for example, a fill chute of a card with fiber tufts. In particular, the risks are high that a uniform deposition of fiber material in the fill chutes of cards is adversely affected by a pneumatic fiber tuft conveyance which takes place in upstream-arranged opening and/or cleaning machines. Such a disturbance, in turn, adversely affects the effort to maintain constant the sliver or yarn number of a sliver or yarn made of such a fiber material.

The appearance of undesired fiber accumulations in the pneumatic fiber tuft conveying systems is in most instances caused by electrostatic charges. Such charges are generated by friction when turbulences are present in the conveying air stream or by friction between the fiber tufts and the air stream as the fiber tufts are transferred into the conveying air from a processing machine or by friction of the fiber tufts among themselves. Because of the free flight of the fiber tufts in the conveying air stream, the electrostatic charge is not removed and thus remains present until the fiber tufts arrive into contact with an appropriate component which leads away the electrostatic charges. Accumulations of fiber tufts have been observed particularly in case of relatively dry transporting air. Excessive humidity in the transporting air or in the fiber material itself, however, results in a balling of the fiber tufts; this causes not only disturbances in the pneumatic conveying system but has a disadvantageous effect on the quality of the product made from the fibers.

In a known apparatus, in the pneumatic transport conduit in which the fiber tufts are advanced there are arranged a humidity sensor and a temperature sensor which are connected by means of a control device with a water vapor generator and with a heating device, respectively. Thus, a measuring of the humidity and temperature of the fiber tuft-charged air stream is taking place. It is a disadvantage of such an apparatus that the humidity and temperature of the fiber tufts themselves are measured indirectly; the conveying air serves as a medium. It is of particular disadvantage that the air stream is not steady but fluctuates in pressure and velocity.

SUMMARY OF THE INVENTION

It is an object of the invention to provide an improved apparatus of the above-outlined type from which the discussed disadvantages are eliminated and which thus makes possible a better measurement of humidity and/or temperature of the fiber tufts in a simple and reliable manner.

This object and others to become apparent as the specification progresses, are accomplished by the invention, according to which, briefly stated, the humidity and/or temperature sensor is arranged for responding directly to the humidity and/or temperature of the fiber material itself.

By associating the humidity sensor directly with the fiber material, the humidity measurement becomes simpler and, at the same time, more reliable. If temperature measurements are to be performed as well, such are effected by a direct contact between the temperature sensor and the fiber material.

DESCRIPTION OF THE PREFERRED EMBODIMENTS

Figure 1:
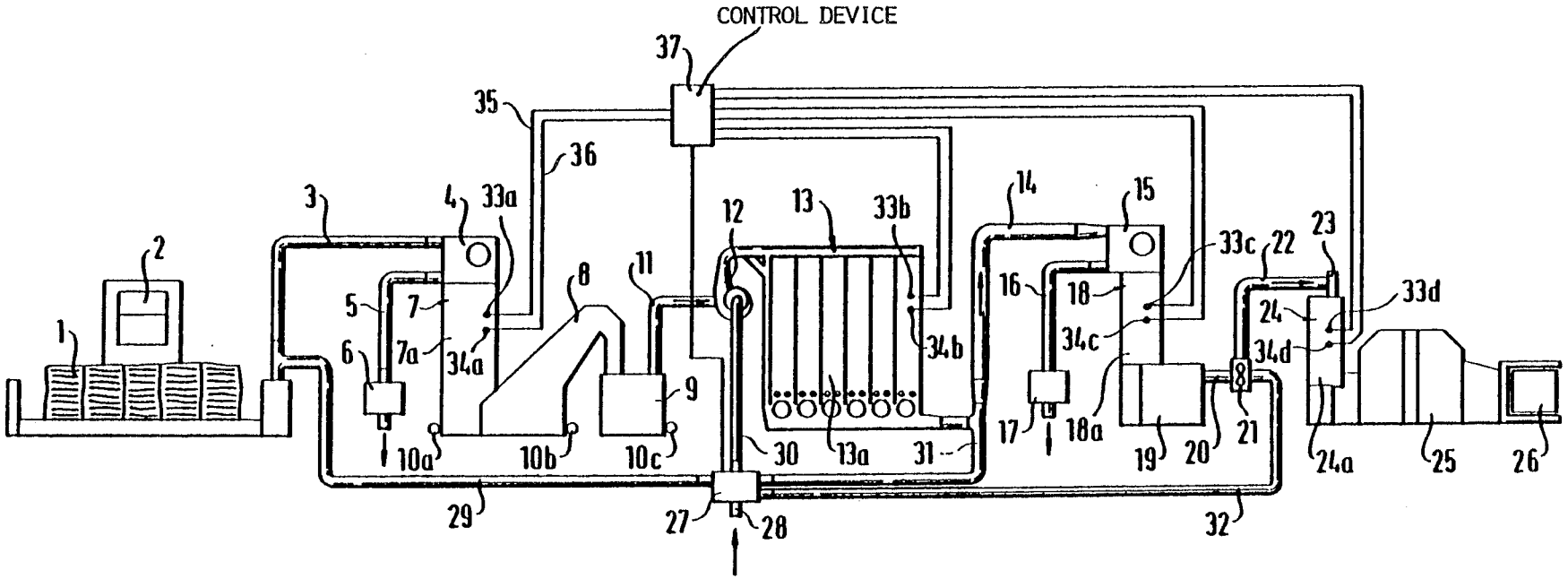
FIG. 1 is a schematic side elevational view, with block diagram, of a preferred embodiment of the invention, associated with a fiber cleaning line.

FIG. 1 shows a textile fiber cleaning line, composed of a plurality of machines interconnected by tubular conveying conduits. A series of fiber bales 1 is opened by a bale opener 2 which may be, for example, a BLENDOMAT BDT model, manufactured by Trützschler GmbH & Co. KG, Mönchengladbach, Federal Republic of Germany. The fiber tufts removed from the fiber bales 1 by the bale opener 2 are advanced in a conveying conduit 3 to a condenser 4 which separates the fibers from the conveying air stream. The transporting air is released, for example, into the cleaning room through a conduit 5 and a filter 6.

Downstream of the condenser 4 there is arranged a charging device 7, including a fill chute, for a stage or stepped cleaner 8, followed by another cleaner 9 which has sawtooth cleaning rolls. At the lower end of the charging device 7, the stepped cleaner 8 and the cleaner 9, waste removal conduits 10*a*, 10*b* and 10*c* are arranged. The cleaner 9 is connected by a tubular conduit 11 with the intake side of a conveying air stream generating blower 12 which is followed by a multi-chamber mixer 13. The output of the latter is connected by a conveyor conduit 14 with a condenser 15 which separates the fiber tufts from the air stream. The air stream is released, for example, into the cleaning room through a conduit 16 and a filter 17.

A charging device 18, including a charging chute, is arranged downstream of the condenser 15. The charging device 18 supplies fiber material to a fine opener 19 from which the fiber tufts are admitted through a conveying conduit 20 into the intake side of a conveying air stream generating blower 21. A plurality of card feeders 24 with feed chutes (of which only one is shown), such as EXACTAFEED FBK models, manufactured by Trützschler GmbH & Co. KG is connected by a conveying conduit 22 and a distributor conduit 23. The card feeders 24 compress the fiber tufts into a fiber lap supplied to respective carding machines 25 which make a sliver formed of parallelized fibers. The sliver is processed by sliver coilers, deposited into coiler cans 26 and then advanced to the successive machine of the spinning process, for example, a drafting frame.

A central air conditioning system 27 which has an air inlet opening 28, is connected with the conduit 3 by means of a conduit 29, with the blower 12 by means of a conduit 30, with the conduit 14 by means of a conduit 31 and with the blower 21 by means of a conduit 32. The conditioned air supplied by the air conditioning system 27 is thus directly introduced into the fiber guiding spaces 3, 12, 14 and 21 by conduits 29–32. In this manner the conditioned air affects directly the substantially opened fiber tufts, whereby a rapid conditioning thereof is achieved. The air discharged into the cleaning room from filters 6 and 17 may be at least partially reintroduced through the air intake opening 28 into the air conditioning system 27.

The charging device 7 has a fill chute 7*a* in which the fiber tufts are deposited. With the fill chute 7*a* there are associated a humidity measuring sensor 33*a* and a temperature measuring sensor 34*a*. The mixer 13 has a plurality of mixing chambers 13*a* for receiving the fiber tufts. At least one chamber 13*a* has a humidity measuring sensor 33*b* and a temperature measuring sensor 34*b*. The charging device 18 has a fill chute 18*a* in which there are arranged a humidity measuring sensor 33*c* and a temperature measuring sensor 34*c*. The card feeder 24 has a feed chute 24*a* which is associated with a humidity measuring sensor 33*d* and a temperature measuring sensor 34*d*. By virtue of the fact that the humidity measuring sensors 33*a*–33*d* and the temperature measuring sensors 34*a*–34*d* are associated directly with the fiber material, the humidity and temperature of the fiber material are measured directly. The humidity measuring sensors 33*a*–33*d* and the temperature measuring sensors 34*a*–34*d* are connected by conductors 35, 36 with a regulating and control device 37 which may be a TMS model microcomputer manufactured by Trützschler GmbH & Co. KG and which is connected with the regulatable and controllable air conditioning system 27.

Figure 2:
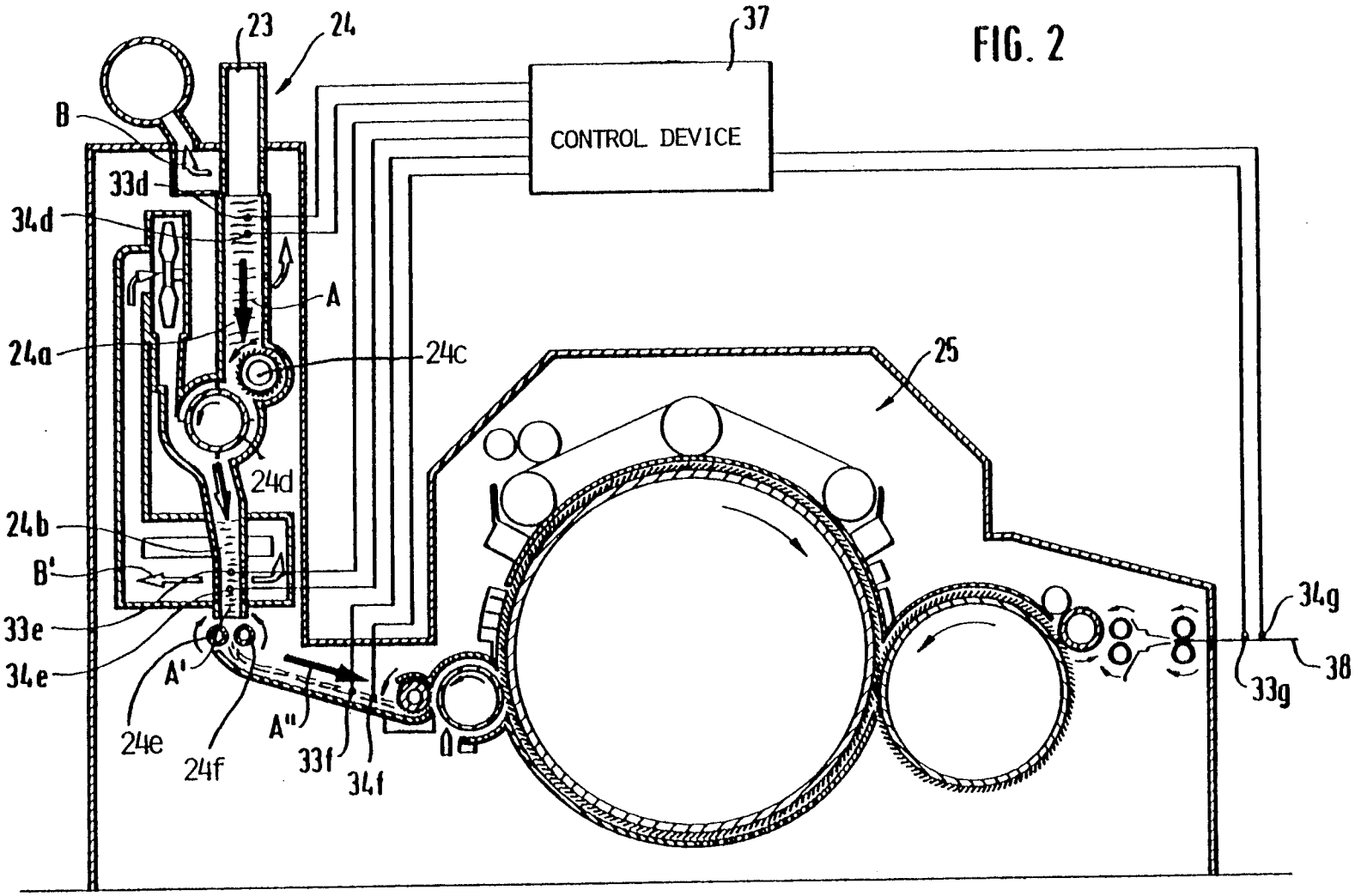
FIG. 2 is a schematic side elevational view of a fiber tuft feeder and a carding machine, incorporating another preferred embodiment of the invention.

Turning to FIG. 2, the fiber tufts, carried by the conditioned air, are admitted from the pneumatic conveying and distributing conduit 23 into an upper, reserve chute 24*a* of the card feeder 24. The conditioned conveying air is guided through air outlet openings in the wall of the reserve chute 24*a* into the ambient atmosphere through a non-illustrated filter, while the fiber tufts symbolized by the arrow A are advanced by a feed roll 24*c* and an opening roll 24*d* into a lower, feed chute 24*b*. From the feed chute 24*b* the fiber tufts A′ are drawn out of the feed chute 24*b* by delivery rolls 24*e*, 24*f* and are advanced thereby as a fiber lap A″ to the carding machine 25. Arrows A, A′ and A″ thus designate the course of the fiber tufts, while the arrows B and B′ designate the course of the conveying air. In the reserve chute 24*a* there are arranged a humidity measuring sensor 33*d* and a temperature measuring sensor 34*d* and in the feed chute 24*b* there are arranged a humidity measuring sensor 33*e* and a temperature measuring sensor 34*e*, while the fiber lap A″ is contacted by a humidity measuring sensor 33*f* and a temperature measuring sensor 34*f*.

The output of the fiber feeder 24 is connected with a carding machine 25 which may be, for example, an EXACTACARD DK 740 model, manufactured by Trützschler GmbH & Co. KG. The carding machine 25 discharges a fiber sliver 38 which is contacted by a humidity measuring sensor 33*g* and a temperature measuring sensor 34*g*. The humidity, measuring sensors 33*d*–33*g* and the temperature measuring sensors 34*d*–34*g* are electrically connected with the regulating and control device 37 which, as noted earlier, regulates and controls the air conditioning system 27.

Figure 3:
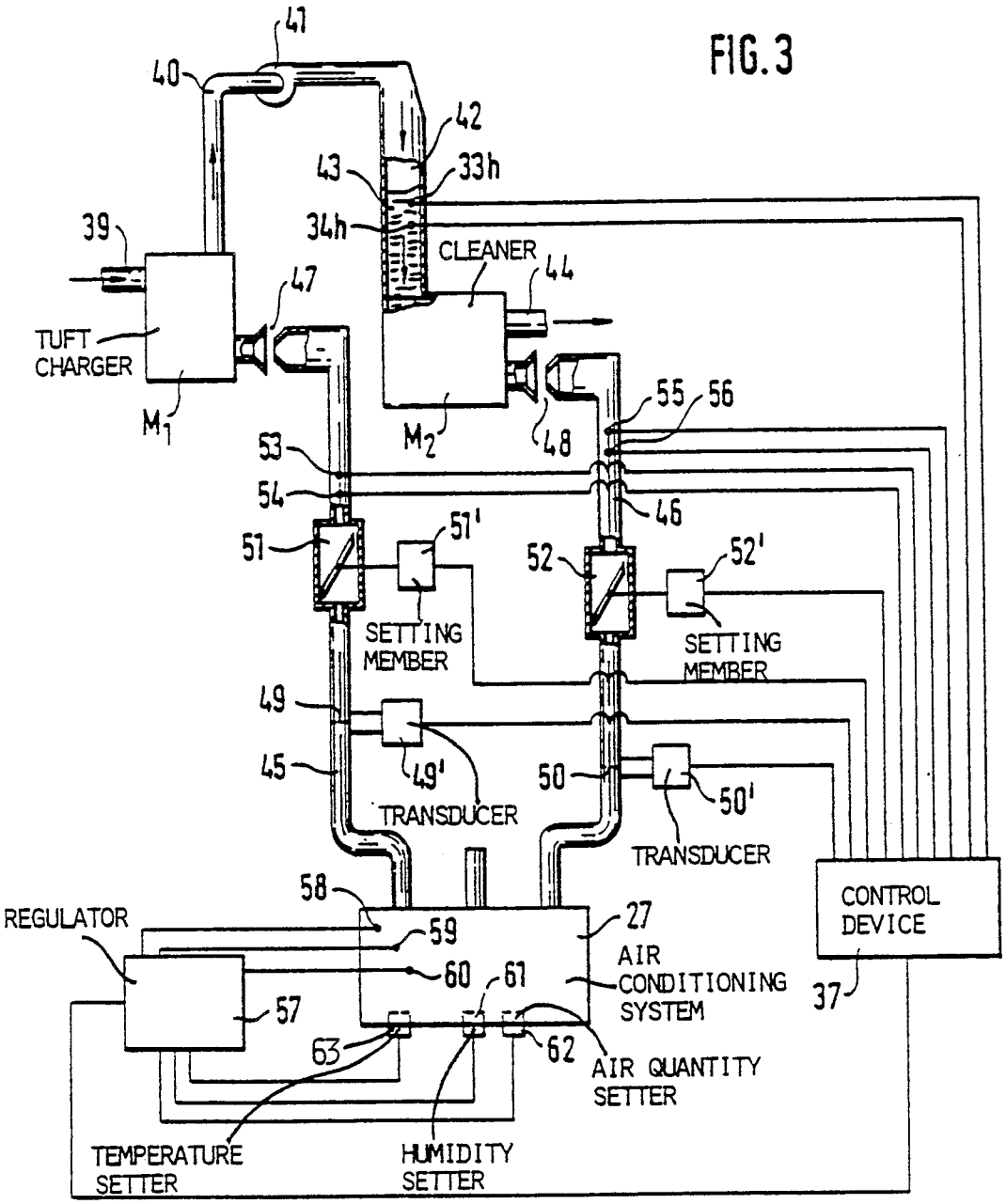
FIG. 3 is a schematic side elevational view, with block diagram, showing control and regulating devices of the apparatus.

In FIG. 3, there are illustrated a spinning preparation machine $M_1$, such as a charging device and an afterconnected spinning preparation machine $M_2$, such as a cleaner. The fiber material is advanced pneumatically through a conveyor conduit 39 into the fiber guiding spaces of the machine $M_1$ and therefrom the fiber material is pneumatically advanced into a filling chute 42 (feed chute) through a conduit 40 and a blower 41. The fiber tufts are deposited in the feed chute 42 to form a fiber tuft column 43 therein. From the feed chute 42 the fiber material is advanced into the machine $M_2$ and therefrom it is advanced pneumatically in a conveyor conduit 44 to a non-illustrated further processing machine. The air conditioning system 27 supplies conditioned air through conduit 45 into the fiber guiding spaces of the machine $M_1$ and through the conduit 46 into the fiber guiding spaces of the machine $M_2$. To ensure a pressure-free transition, air inlet openings 47 and 48 are provided in the conduits 45 and 46 to permit the inflow of fresh air from the ambient atmosphere.

Further, in the conduits 45 and 46 there are installed a flow quantity measuring device 49 and 50, respectively, and a quantity setting device 51 and 52 such as a throttle or the like. The fiber column 43 in the feed chute 42 is contacted by a humidity measuring sensor 33*h* and a temperature measuring sensor 34*h* which are electrically connected with the control device 37. The following additional components are connected to the regulating device 37: a humidity measuring sensor 53 and a temperature measuring sensor 54 arranged in the conduit 45, a humidity measuring sensor 55 and a temperature measuring sensor 56 arranged in the conduit 46, a setting member 51′ of the quantity setting device 51, a setting member 52′ of the quantity setting device 52, a measuring value transducer 49′ for the throughput quantity measuring device 49 and a measuring value transducer 50′ for the throughput quantity measuring device 50.

The control and regulating device 37 is electrically connected with a regulator 57 for the temperature, humidity and air quantity conditions in the air conditioning system 27. In the air conditioning system 27 there are disposed a temperature measuring member 58, a humidity measuring member 59 and an air quantity measuring member 60 which, in turn, are connected to the regulator 57. Further, the regulator 57 is electrically connected with a humidity setting member 61, an air quantity setting member 62 and a temperature setting member 63. The components 61, 62 and 63 are connected with the air conditioning system 27 as well.

The data exchange between the regulators 37 and 57 may be effected by a superposed SPS or MC control. (SPS=storage programmable control; MC=microcomputer)

With the above-described system the temperature, humidity and/or air quantities are changed or regulated.

It will be understood that the above description of the present invention is susceptible to various modifications, changes and adaptations, and the same are intended to be comprehended within the meaning and range of equivalents of the appended claims.

What is claimed is:

1. In a fiber tuft processing line for processing fiber tufts preparatory to spinning, including
- a plurality of fiber processing machines,
- fiber tuft conveying ducts serially connecting the machines,
- blower means for generating a fiber tuft conveying air stream flowing in the fiber tuft conveying ducts, and
- an air conditioning system for supplying conditioned air to the machines of the fiber processing line; the air conditioning system including
  - an air conditioner;
  - conditioned air conveying ducts extending from an output of the air conditioner to the machines;
  - humidity sensing means and temperature sensing means for responding to humidity and temperature conditions in the processing line; and
  - regulator means for operatively connecting the humidity sensing means and the temperature sensing means with said air conditioner,
- the improvement wherein said humidity sensing means includes a humidity sensor responding directly to the humidity of the fiber tufts in the processing line; further wherein one of said machines is a carding machine, and said humidity sensor directly contacts a fiber lap advanced into the carding machine.

2. A fiber tuft processing line as defined in claim 1, further comprising means for defining an opening in said conditioned air conveying ducts to provide for a passage of additional air.

3. A fiber tuft processing line as defined in claim 1, wherein said temperature sensing means includes a temperature sensor responding directly to the temperature of the fiber tufts in the processing line.

4. A fiber tuft processing line as defined in claim 3, further comprising means for defining a space filled with fiber tufts; said humidity sensor being arranged in said space.

5. A fiber tuft processing line as defined in claim 4, wherein said means for defining a space comprises a fill chute supplying one of said machines with fiber tufts.

6. A fiber tuft processing line as defined in claim 3, wherein said temperature sensor directly contacts the fiber tufts.

7. A fiber tuft processing line as defined in claim 6, further comprising means for defining a space filled with fiber tufts; said temperature sensor being arranged in said space.

8. A fiber tuft processing line as defined in claim 7, wherein said means for defining a space comprises a fill chute supplying one of said machines with fiber tufts.

9. In a fiber tuft processing line for processing fiber tufts preparatory to spinning, including
- a plurality of fiber processing machines,
- fiber tuft conveying ducts serially connecting the machines,
- blower means for generating a fiber tuft conveying air stream flowing in the fiber tuft conveying ducts, and
- an air conditioning system for supplying conditioned air to the machines of the fiber processing line; the air conditioning system including
  - an air conditioner;
  - conditioned air conveying ducts extending from an output of the air conditioner to the machines;
  - humidity sensing means and temperature sensing means for responding to humidity and temperature conditions in the processing line; and
  - regulator means for operatively connecting the humidity sensing means and the temperature sensing means with said air conditioner,
- the improvement wherein said humidity sensing means includes a humidity sensor responding directly to the humidity of the fiber tufts in the processing line; further wherein one of said machines is a carding machine, and said humidity sensor directly contacts a fiber sliver delivered by the carding machine.

10. In a fiber tuft processing line for processing fiber tufts preparatory to spinning, including
- a plurality of fiber processing machines,
- fiber tuft conveying ducts serially connecting the machines,
- blower means for generating a fiber tuft conveying air stream flowing in the fiber tuft conveying ducts, and
- an air conditioning system for supplying conditioned air to the machines of the fiber processing line; the air conditioning system including
  - an air conditioner;
  - conditioned air conveying ducts extending from an output of the air conditioner to the machines;
  - humidity sensing means and temperature sensing means for responding to humidity and temperature conditions in the processing line; and
  - regulator means for operatively connecting the humidity sensing means and the temperature sensing means with said air conditioner,
- the improvement wherein said humidity sensing means includes a humidity sensor responding directly to the humidity of the fiber tufts in the processing line; further wherein said fiber processing machines include inner spaces, and said conditioned air conveying ducts introducing conditioned air into said spaces.

11. A fiber tuft processing line as defined in claim 10, further comprising setting means for varying at least one of a flow rate, humidity and temperature of the conditioned air; further comprising a control device having an input connected with at least one of the sensing means and an output connected with said setting means.

12. In a fiber tuft processing line for processing fiber tufts preparatory to spinning, including a plurality of fiber processing machines, fiber tuft conveying ducts serially connecting the machines, blower means for generating a fiber tuft conveying air stream flowing in the fiber tuft conveying ducts, and an air conditioning system for supplying conditioned air to the machines of the fiber processing line; the air conditioning system including an air conditioner;

conditioned air conveying ducts extending from an output of the air conditioner to the machines;

humidity sensing means and temperature sensing means for responding to humidity and temperature conditions in the processing line; and regulator means for operatively connecting the humidity sensing means and the temperature sensing means with said air conditioner, the improvement wherein said humidity sensing means includes a humidity sensor responding directly to the humidity of the fiber tufts in the processing line; further wherein said temperature sensing means includes a temperature sensor responding directly to the temperature of the fiber tufts in the processing line; and further wherein one of said machines is a carding machine, and said temperature sensor directly contacts a fiber lap advanced into the carding machine.

13. In a fiber tuft processing line for processing fiber tufts preparatory to spinning, including a plurality of fiber processing machines, fiber tuft conveying ducts serially connecting the machines, blower means for generating a fiber tuft conveying air stream flowing in the fiber tuft conveying ducts, and an air conditioning system for supplying conditioned air to the machines of the fiber processing line; the air conditioning system including an air conditioner;

conditioned air conveying ducts extending from an output of the air conditioner to the machines;

humidity sensing means and temperature sensing means for responding to humidity and temperature conditions in the processing line; and regulator means for operatively connecting the humidity sensing means and the temperature sensing means with said air conditioner, the improvement wherein said humidity sensing means includes a humidity sensor responding directly to the humidity of the fiber tufts in the processing line; further wherein said temperature sensing means includes a temperature sensor responding directly to the temperature of the fiber tufts in the processing line; and wherein one of said machines is a carding machine, and wherein said temperature sensor directly contacts a fiber sliver delivered by the carding machine.

* * * * *